US008725405B2

(12) United States Patent
Steffen, II et al.

(10) Patent No.: US 8,725,405 B2
(45) Date of Patent: May 13, 2014

(54) METHODS AND SYSTEM FOR CROSSING PREDICTION

(75) Inventors: Michael W. Steffen, II, Melbourne, FL (US); Brian Wesley Isaacson, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/446,659

(22) Filed: Apr. 13, 2012

(65) Prior Publication Data

US 2013/0270395 A1 Oct. 17, 2013

(51) Int. Cl.
*B61L 23/00* (2006.01)

(52) U.S. Cl.
USPC ..... 701/400; 701/19; 246/125

(58) Field of Classification Search
None
See application file for complete search history.

(56) References Cited

U.S. PATENT DOCUMENTS

| | | | | | |
|---|---|---|---|---|---|
| 3,246,143 | A * | 4/1966 | Steele et al. | 246/128 |
| 3,603,786 | A * | 9/1971 | Peel | 246/128 |
| 3,619,604 | A * | 11/1971 | Auer et al. | 246/102 |
| 3,944,173 | A * | 3/1976 | Moe et al. | 246/34 CT |
| 3,974,991 | A * | 8/1976 | Geiger | 246/34 CT |
| 4,306,694 | A * | 12/1981 | Kuhn | 246/125 |
| 4,307,860 | A * | 12/1981 | Kuhn | 246/128 |
| 4,324,376 | A | 4/1982 | Kuhn | |
| 4,365,777 | A * | 12/1982 | Geiger | 246/130 |
| 4,581,700 | A * | 4/1986 | Farnham et al. | 700/80 |
| 5,924,652 | A * | 7/1999 | Ballinger | 246/126 |
| 6,218,961 | B1 * | 4/2001 | Gross et al. | 340/903 |
| 6,392,661 | B1 * | 5/2002 | Tankersley | 345/660 |
| 6,836,221 | B1 * | 12/2004 | Boddie et al. | 340/901 |
| 7,254,467 | B2 * | 8/2007 | Fries et al. | 701/19 |
| 7,832,691 | B2 * | 11/2010 | Reibeling et al. | 246/125 |
| 8,590,844 | B2 * | 11/2013 | Hogan | 246/34 B |
| 2004/0181321 | A1 * | 9/2004 | Fries et al. | 701/19 |
| 2006/0015224 | A1 * | 1/2006 | Hilleary | 701/19 |
| 2007/0084974 | A1 * | 4/2007 | Sharkey et al. | 246/473.1 |
| 2007/0276600 | A1 * | 11/2007 | King et al. | 701/301 |
| 2009/0182492 | A1 * | 7/2009 | Alten | 701/200 |
| 2009/0184214 | A1 * | 7/2009 | Reibeling et al. | 246/125 |
| 2011/0095139 | A1 * | 4/2011 | O'Dell | 246/293 |
| 2011/0226909 | A1 * | 9/2011 | O'Dell et al. | 246/126 |
| 2012/0155314 | A1 * | 6/2012 | Miyata | 370/252 |
| 2012/0217351 | A1 * | 8/2012 | Chadwick et al. | 246/169 R |
| 2012/0248261 | A1 * | 10/2012 | Nichter | 246/125 |
| 2013/0041577 | A1 * | 2/2013 | Puhalla et al. | 701/124 |
| 2013/0062474 | A1 * | 3/2013 | Baldwin et al. | 246/122 R |

OTHER PUBLICATIONS

Exponential Smoothing Method, Jun. 12, 2007.*

Averaging and Exponential Smoothing Models, http://people.duke.edu/~rnau/411avg.htm.*

Sensor Fusion using the Kalman Filter, Mar. 2005.* Robert F. Nau, Averaging and Exponential Smoothing Models, Accessed Jun. 5, 2013 (No publication date), http://people.duke.edu/~rnau/411avg.htm.*

Search Report and Written Opinion from corresponding PCT Application No. PCT/US2013/033396 dated Aug. 23, 2013.

* cited by examiner

*Primary Examiner* — Fadey Jabr
*Assistant Examiner* — Krishnan Ramesh
(74) *Attorney, Agent, or Firm* — GE Global Patent Operation; John A. Kramer

(57) ABSTRACT

Various methods and systems are provided for predicting crossing times. In one embodiment, a method comprises determining a vehicle position of a vehicle from sensed data, filtering the vehicle position, determining vehicle velocity based on the filtered vehicle position, filtering the vehicle velocity to a greater extent than vehicle position is filtered, at least above a threshold frequency, and determining a time-to-crossing based on the filtered vehicle position and filtered velocity.

19 Claims, 6 Drawing Sheets

METHODS AND SYSTEM FOR CROSSING PREDICTION

FIELD

Embodiments of the subject matter disclosed herein relate to a vehicle crossing prediction system.

BACKGROUND

Railroad crossing prediction circuits deliver warning times prior to a train or other vehicle reaching a crossing, based on a position signal, for example. However, when the position signal deteriorates or is subject to a large amount of noise, it can be very difficult to obtain accurate warning times. Thus, if the position signal is too noisy, it is difficult for the prediction circuit to tell the difference between noise and motion on the track. Short warning times usually occur when motion is detected too late for the predictor to give adequate warning time. Long warning times often are the result of noisy signals that make the train appear closer than it actually is. Short warning times can prevent pedestrians, automobiles, and other transportation vehicles from having enough notice to stop prior to a train reaching the crossing. If a warning time is too long, pedestrians in particular may begin to move across the gates, assuming that the warning is a false alarm.

BRIEF DESCRIPTION

In one embodiment, a method comprises determining a vehicle position from sensed data, filtering the vehicle position, and determining vehicle velocity based on the filtered vehicle position. The method also includes filtering the vehicle velocity to a greater extent than vehicle position is filtered, at least above a threshold frequency, and determining a time-to-crossing based on the filtered vehicle position and filtered velocity.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The following description relates to various embodiments of a crossing prediction system. In particular, in an embodiment of the system, a controller associated with a crossing includes an algorithm that improves warning time accuracy when the position signal is distorted. The system guards against both short and long warning times and reduces the risk of both long and short warning times resulting from distorted prediction signals. In one example, the system (e.g., as carried out by the controller executing the algorithm) may utilize a smoothened velocity signal. As velocity of a vehicle, such as a train, is likely to change relatively slowly, the crossing predication time may be based on averaged velocity rather than averaged position. In this way, warning time accuracy may be increased.

Figure 1:
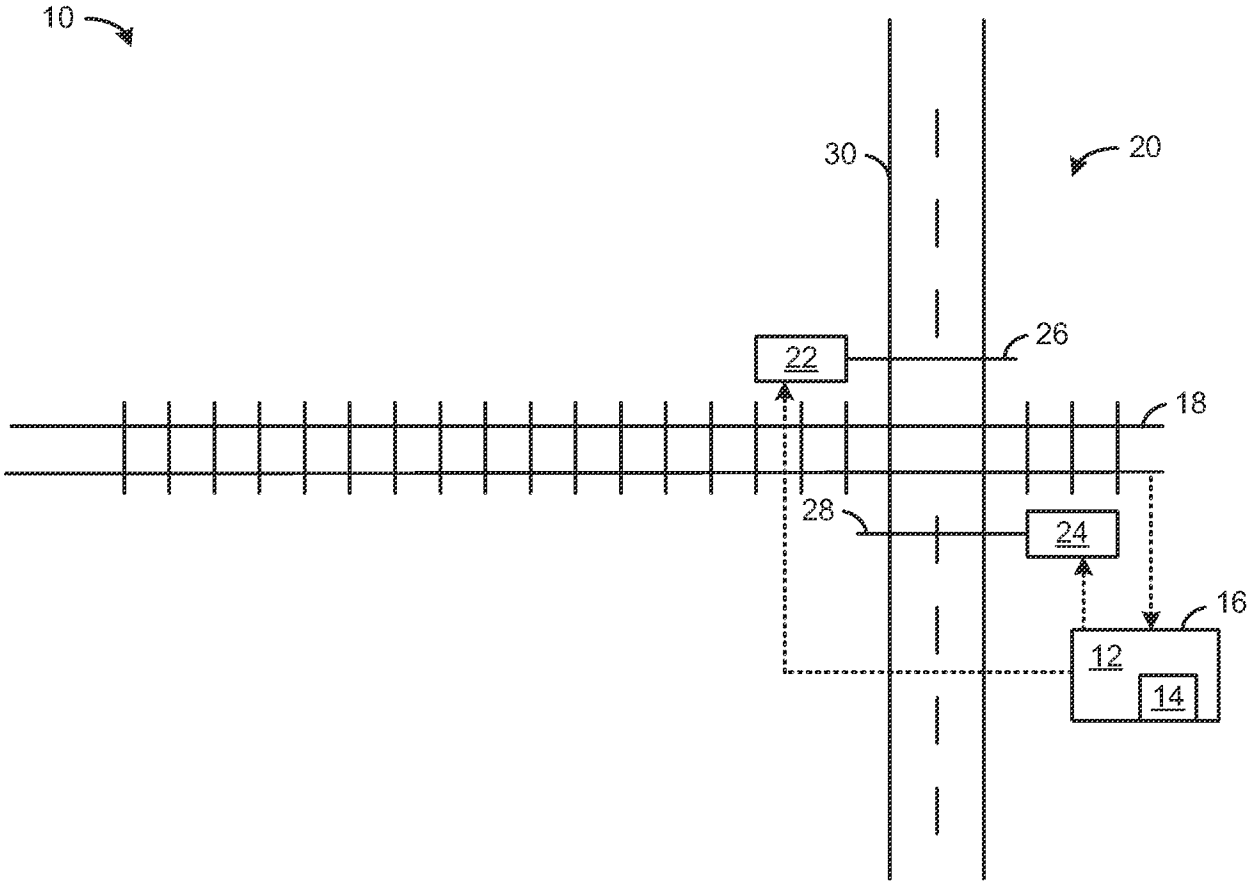
FIG. 1 shows a simplified map of a crossing, according to an embodiment.

FIG. 1 is a simplified block diagram of a crossing system 10 according to one embodiment of the invention. Crossing system 10 includes a crossing 20 where a first vehicle path intersects a second path, such as where a road 30 intersects a rail track 18. The crossing system 10 also includes a bungalow 16 or other housing that houses a controller 12, and warning equipment 22, 24 that lowers gate arms 26, 28 when activated due to the predicted presence of a vehicle, such as a train (not shown), on track 18. A processor 14 is part of the controller 12 and may provide calculations as to the whether to activate or deactivate the crossing according to embodiments of the disclosure. The controller 12 further includes non-transitory computer readable storage media including code for enabling control of various components of the crossing system 10. The controller 12 is responsive to one or more signals to activate the crossing equipment and prevent entry into the crossing. For example, one or more shunts, transmitters, and receivers (not shown in FIG. 1) may be present on both sides of the crossing 20 in order to provide signals to the controller 12 for determining a position and speed of a vehicle based on a change in impedance on the track. Transmission communications as used herein may be via a hardwired connection, via a radio link, or via field wiring for example.

This activation of the warning equipment causes the gate arms to drop, blocking oncoming traffic in both directions on road 30. Each gate arm may extend across a portion of the road 30. This feature restricts entry to a prohibited area roughly defined as the area around and between railroad crossing warning equipment 22, 24. Further, the activation of the warning equipment may cause one or more warning lights to flash, warning sirens to activate, and/or may cause activation of a motion detect relay system which may control traffic lights within the area of the crossing.

As a rail vehicle or other vehicle approaches the crossing 20 along the rail track 18 or other vehicle path, the controller uses signals to determine the speed and position of the vehicle. Based on the speed and position, a time-to-crossing may be determined. The time-to-crossing may be a countdown that reaches zero in proportion to the distance of the vehicle from the crossing, and may be adjusted as vehicle speed changes. Once the time-to-crossing reaches a threshold (such as a minimum amount of time to activate the warning equipment ahead of the vehicle arriving at the crossing), the warning equipment is activated.

Figure 2:
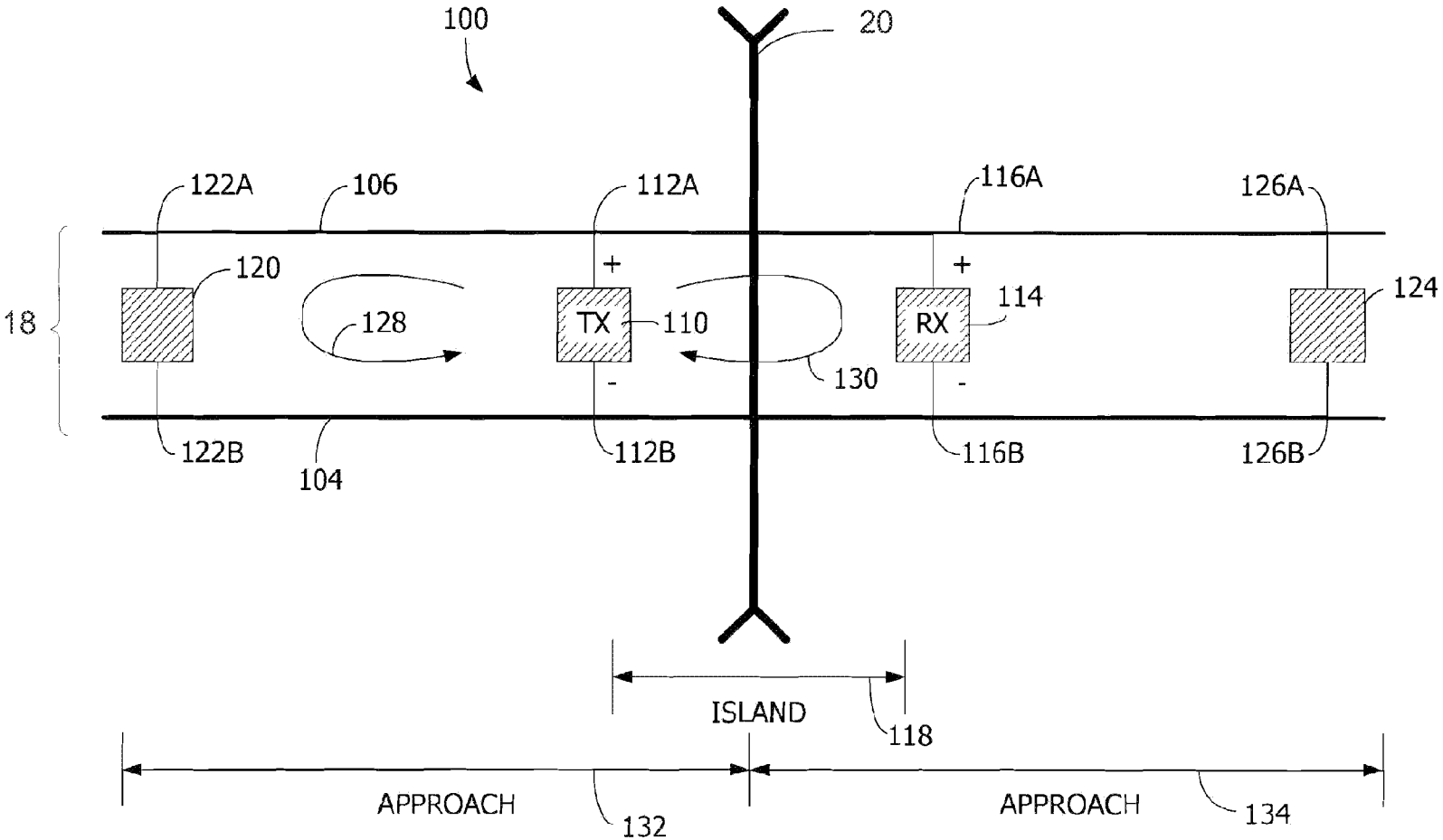
FIG. 2 shows a schematic illustration of a crossing detection system, according to an embodiment, which may be included in the crossing of FIG. 1.

FIG. 2 illustrates a railroad grade crossing warning system 100 with a single railroad track 18 that is comprised of a pair of running track rails 104 and 106 and the crossing 20. Railroad grade crossing warning system 100 may be present in the crossing system of FIG. 1 in order to detect a vehicle upstream of the crossing (upstream means in a direction heading towards the crossing). For proper operation, the railroad track on either side of the road crossing 20 may be monitored for the presence and movement of a train approaching on the track 18 from either side of road crossing 20. The maximum length of a railroad grade crossing system's surveillance area, or effective approach distance, may be limited by external conditions and by the frequency of the detection signal applied to the track 18.

A railroad grade crossing warning system 100 may employ two different track circuits to perform train motion and presence detection. By measuring the voltage and current and determining the impedance of the track between the crossing and the train, the approach track circuit 128 detects the motion of an approaching train at a distance up to, for example, 2,300 meters on either side of the road crossing 20. The approach track circuit 128 determines the distance of the train from the road crossing and detects the movement of the train within the approach track surveillance area 132 and 134. The approach track system measures the voltage, current, and/or impedance and provides this data to an external crossing system that determines the speed of the approaching train and the time for the arrival of the train at the crossing based on the distance and the speed. The presence, position, and arrival time of the train are used to provide a time-to-crossing notification of the crossing signal systems. A time-to-crossing of at least twenty seconds prior to the arrival of the train that is independent of the speed of the train is frequently utilized as a warning time to activate the crossing equipment. The minimum required distance of the surveillance area on either side of the crossing is a function of the maximum speed for a train traversing that section of track and the desired warning time.

The island track circuit 130 measures the presence of a train within an "island" which is a section of track in close proximity to the road crossing 20. The island 118 is relatively short distance spanning the road crossing 20, for example around 30 to 140 meters. The island 118 provides a secure area that ensures that the crossing warnings systems operate when a train is near or within the island 118.

FIG. 2 further illustrates a transmitter 110 with two points of attachment 112A and 112B that attach to the rails 106 and 104 of track 18 on one side of the road crossing 20. The transmitter may be positioned a distance from the road crossing 20, such as between 15-60 meters away. A receiver 114 also has two points of attachment to rails 106 and 104 of track 18 on the other side of the road crossing 20 from the transmitter 110. The receiver may be positioned away from the road crossing 20, such as at a distance of 15-60 meters. The distance between the transmitter 110 and receiver 114 is referred to as the island 118 with the transmission circuit created on the railway tracks referred to as the island track circuit 130.

At longer distances away from the road crossing 20, on one or both sides of the rail, are termination shunts 120 and 124, which are connected to rails 106 and 104 of track 18 by 122A/122B and 126A/126B, respectively. Shunts 120 and 124 are placed at a relatively longer distance from the road crossing 20, such as between 90 and 2300 meters. The placement of the shunt may be determined based on the expected speed of the trains traversing the crossing and the requirement that the road crossing warning system 100 provides at least a threshold time warning to vehicles and pedestrians using road crossing 20. Termination shunts 120 and 124 are frequency tuned to look like a short circuit to the frequency of the approach track circuit 128, thereby creating track circuit 128. This creates a defined surveillance area 132 and 134 on either side of the crossing 20 within which the approach track circuit and system detects the presence or movement of a train. In some embodiments, both the approach track signal 128 and the island track signal 130 are transmitted onto the track 18 via the same leads 112A and 112B. In other embodiments, a separate transmitter 110 may transmit the approach track signal 128 separate from the island track signal 130. Additionally, in other embodiments, a separate receiver 114 may receive the approach track signal 128 separate from the island track signal 130.

The approach track circuit may operate in the frequency range of, for example, 80 to 1,000 Hz. The approach track circuit 128 may use a lower range of frequencies compared to the island track circuit 130. Lower frequencies provide for longer distance detection capabilities due to the extended distance over which the impedance of the track is linear as a function of distance. The approach track signal propagates over long distances of track extending out from the crossing (called the approaches). The approaches are terminated by tuned shunts at the endpoints away from the crossing, providing fixed impedance for each approach section at the tuned frequency. The receiver monitors the received voltage and the transmitter monitors the transmitted current, which are then used to determine the impedance of the approach track circuit. The system monitors changes in the approach track circuit voltage and current levels. As a train (or other rail vehicle or other vehicle) moves into the approach, the axles provide an electrical shunt, which changes the impedance of the approach track circuit as seen by the detection system. The rate of change in this impedance is proportional to the speed of the train, thus providing for the detecting of the movement of the train. Using this information, the system may calculate a time at which the train will be at the crossing. In some systems, a time-to-crossing warning time can be provided to motorists at the crossing independent of the speed of the train.

The island track circuit 130 may operate at higher frequencies to detect the presence of a train (or other rail vehicle or other vehicle) in the shorter island surveillance area 118. Typical operating frequencies are in the range of 2 kHz to 20 kHz. When a train enters the island area 118, the axle of the train shunts the island signal so that the signal transmitted is prevented from getting to the receiver. In this operation, the island track circuit 130 and detection system determines that the train is in close proximity to the road crossing 20 and ensures that the warning systems are operating, and are not released until the train clears the island. In other island track circuit systems, the island track signal includes randomly generated codes, either on a continuous or burst basis. In these systems, when one or more consecutive codes fail to be received by the receiver, the warning system is activated. As a safeguard, the system is typically not deactivated, e.g., the all-clear signal is sent, until a predefined number of correctly received consecutive codes have been received.

While the embodiment described above utilizes both an approach track circuit and an island track circuit in order to detect train position and speed relative to a crossing, in some embodiments only one circuit may be used. For example, the approach track circuit may be used without the island track circuit.

Figure 3:
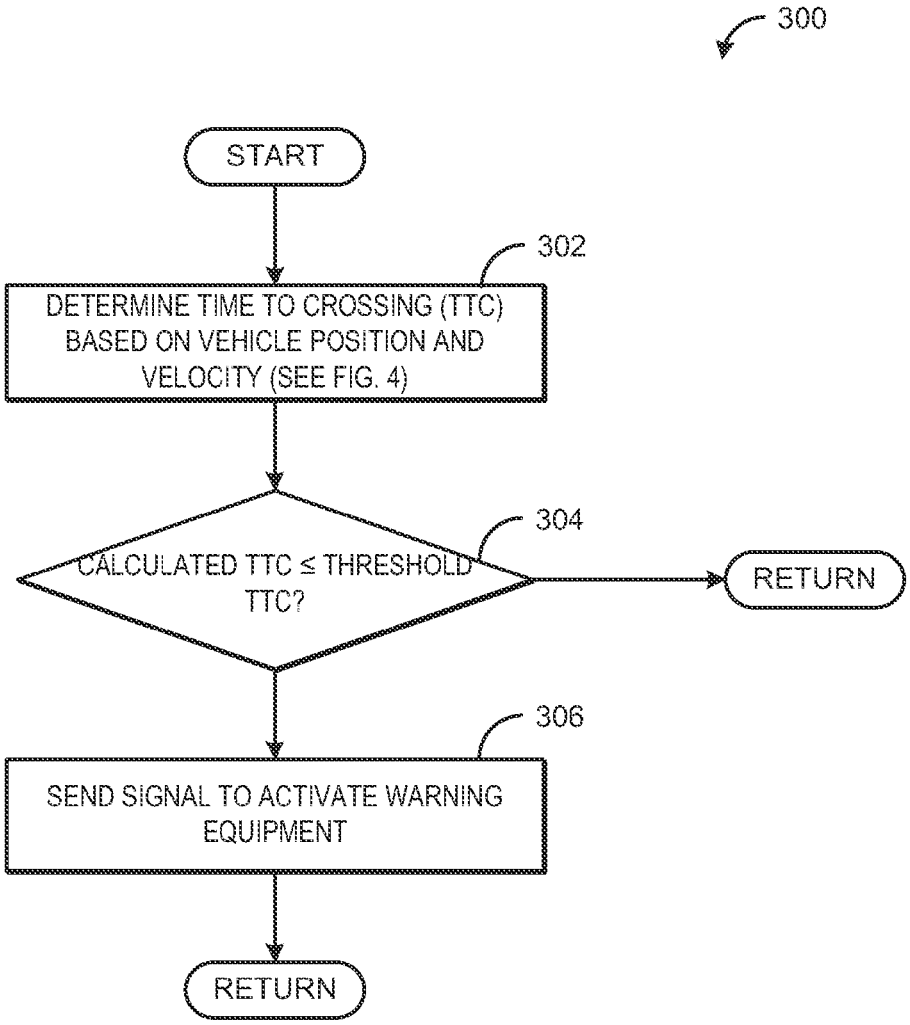
FIG. 3 is a flow chart illustrating a method for a crossing prediction according to an embodiment of the present disclosure.

Turning to FIG. 3, a method 300 for activating a crossing is depicted. Method 300 may be carried out according to instructions stored in a crossing controller, such as controller 12 of FIG. 1. At 302, method 300 includes determining a time-to-crossing (TTC) of a vehicle traveling towards the crossing based on the position and velocity of the vehicle. The TTC is an amount of time for the vehicle to reach the crossing from a predetermined location, that is updated as vehicle velocity and position change. Additional details of calculating the TTC will be described in more detail with respect to FIG. 4. At 304, it is determined if the calculated TTC is equal to or less than a threshold TTC. The threshold TTC may be the point at which the controller is configured to activate the warning equipment. For example, the threshold TTC may be 30 seconds prior to reaching the crossing, 20 seconds, etc. If no, method 300 returns to continue to monitor vehicle position and speed in order to determine the TTC. If yes, method 300 proceeds to 306 to send a signal to activate the warning equipment. In some embodiments, the warning equipment may be activated for a preset amount of time, after which it is deactivated on the assumption that the vehicle has passed the crossing. In other embodiments, the crossing system and controller may continue to monitor the vehicle speed and position, and continue to update the TTC. Once the vehicle speed reaches zero, or a position of the vehicle can no longer be detected, and the TTC has reached zero, it is assumed the vehicle has cleared the crossing and the equipment may be deactivated. Method 300 then returns.

Figure 4:
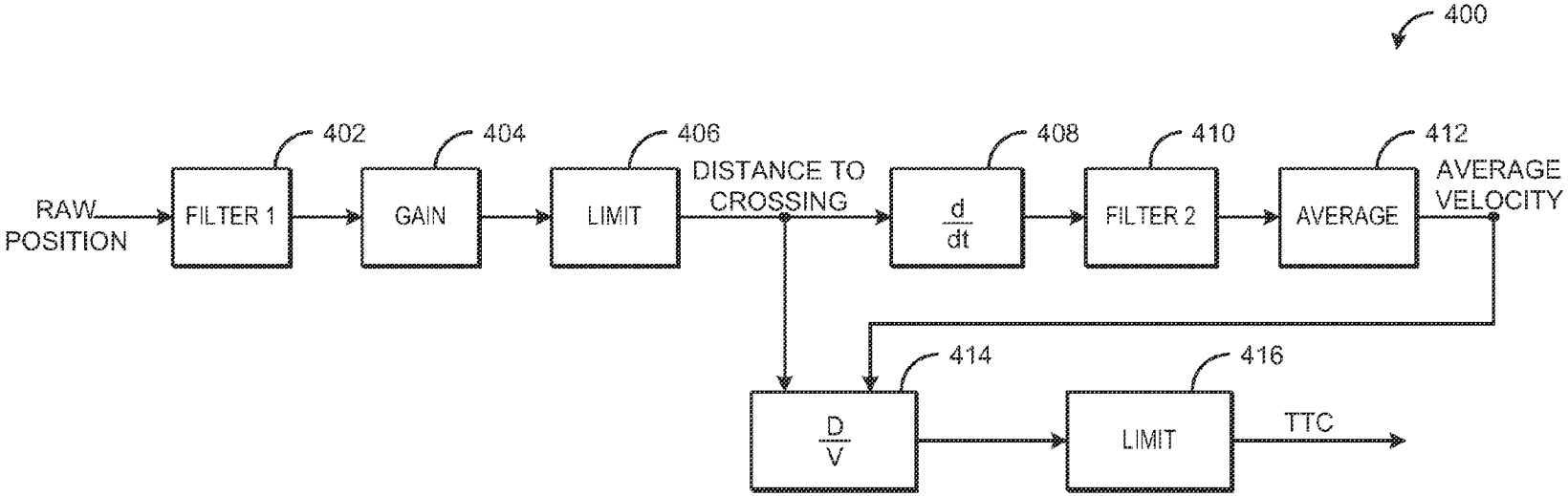
FIG. 4 is a diagram illustrating a control routine for determining a time-to-crossing according to an embodiment of the present disclosure.

FIG. 4 is a control routine 400 for determining a vehicle time-to-crossing based on position and velocity. Routine 400 may be carried out by controller 12 during execution of method 300 of FIG. 3, for example. At 402, raw vehicle position input is applied to a first filter. As explained above, when a vehicle is traveling on a path, such as a train traveling on a rail track, the position of the vehicle may be determined based on sensed data, such as the voltage and current of an approach circuit. The vehicle position may be determined starting from when the vehicle crosses a wire or shunt across the track, the location of which wire or shunt is stored in the controller. As the vehicle approaches the crossing, the position of the vehicle is updated. The determined vehicle position may be filtered, for example by a low-pass filter, or by averaging two or more consecutive positions. At 404, a gain is applied to scale the position in terms of the crossing, such as a percentage distance from the crossing, also called Rx. For example, the position of the shunt on the track may be set at an Rx of 150%, and as the vehicle approaches the crossing, the Rx may decrease. At 406, the Rx may be limited to a maximum value. In one example, the vehicle may have a maximum Rx of 100%, such that its position is reported at 100% even when the vehicle is actually located at an Rx of 120%.

A distance to crossing (DTC) of the vehicle is calculated based on the filtered limited vehicle position. The DTC is determined relative to the approach length, which is the distance between the crossing and the position of the shunt upstream of the crossing. The DTC may be defined as $$\frac{\text{Approach length} \times \text{filtered } Rx}{100}.$$

At 408, the DTC is differentiated with respect to time to calculate vehicle velocity. In one example, the vehicle velocity V may be determined based on the equation:

$$V=4(\mathrm{DTC}_{n-1}\mathrm{DTC}_n)$$

In this embodiment, the data is collected once every ¼ second. However, other embodiments are possible, such as data collected every second, in which the velocity V would be equal to $\mathrm{DTC}_{n-1}-\mathrm{DTC}_n$.

The velocity is filtered at 410. In one embodiment, the filter is a non-linear weighted average velocity. By using a non-linear weighted average, variations in the velocity based on, for example, noise in the position signal may be smoothed, while weighting the velocity towards the most current determined velocity. The non-linear weighted velocity $v_w$ may be determined based on the equation:

$$V_w = 0.3(V_n) + 0.2(V_{n-1} + V_{n-2}) + 0.1(V_{n-3} + V_{n-4} + V_{n-5})$$

A plurality of weighted average velocities may be averaged at 412 in order to determine an overall average weighted velocity, $V_{avg}$. For example, the previous nine $V_w$ may be averaged.

The output of the DTC and filtered average velocity $V_{avg}$ is input at 414 to determine a time-to-crossing (TTC). In some embodiments, the TTC may also include an approach offset. As explained previously, in a crossing circuit, the approach is defined as the distance between the crossing and the shunt at the beginning of the approach. All prediction is based on that distance. However, sometimes it is useful to predict how long it will take for a vehicle to reach a point before or after the crossing. That extra distance is the approach offset. The approach offset is a user defined distance and compensates for a blind portion of the track with no approach circuitry to calculate speed or position. The TTC may be calculated following the equation:

$$TTC = \frac{DTC + \text{Approach offset}}{V_{avg}}$$

At 416, the TTC may be limited, for example the TTC may have a maximum value of 100 seconds. The limited TTC is then output as the calculated TTC and used to determine when to activate the warning equipment at the crossing.

Thus, method 300 of FIG. 3 and routine 400 of FIG. 4 provide for determining a time-to-crossing of a vehicle as it approaches a crossing from a predetermined position. The TTC is dependent on vehicle position and vehicle speed. The vehicle speed may be filtered to a greater extent than the vehicle position, at least above a threshold frequency, thus enabling noise reduction in the TTC signal and allowing for more accurate crossing time predictions. In one example, when the noise to signal ratio is relatively high, the velocity may be filtered to greater extent than the position is filtered. However, when the noise to signal ratio is relatively low, for example during steady state conditions, the velocity and position data may be filtered to a similar extent.

For example, in one embodiment, the velocity may be determined based on a weighted average of the current velocity and a plurality of previous velocities. This may include wherein the current velocity, $V_n$, comprises a first, largest portion of the weighted average, and wherein the plurality of previous velocities comprises a smaller portion of the weighted average. The weighted average may also include the current velocity comprising a first, largest portion of the weighted average, a first and second of the previous velocities immediately previous to the current velocity each comprising a second, smaller portion of the weighted average, and a third, fourth, and fifth of the previous velocities immediately previous to the first and second previous velocities each comprising a third, smallest portion of the weighted average.

In some embodiments, the rate of change of the vehicle position (e.g., Rx) may be monitored during the prediction. For example, if the Rx changes rapidly, it may indicate that a vehicle has entered the track approach circuit from an alternate entry, such as at a rail switch, between the shunt and the crossing. In such circumstances, if the rate of change of the Rx is above a threshold, the controller may cease to calculate the velocity of the vehicle, and hence the TTC, until a time at which the change in Rx has decreased.

Figure 5:
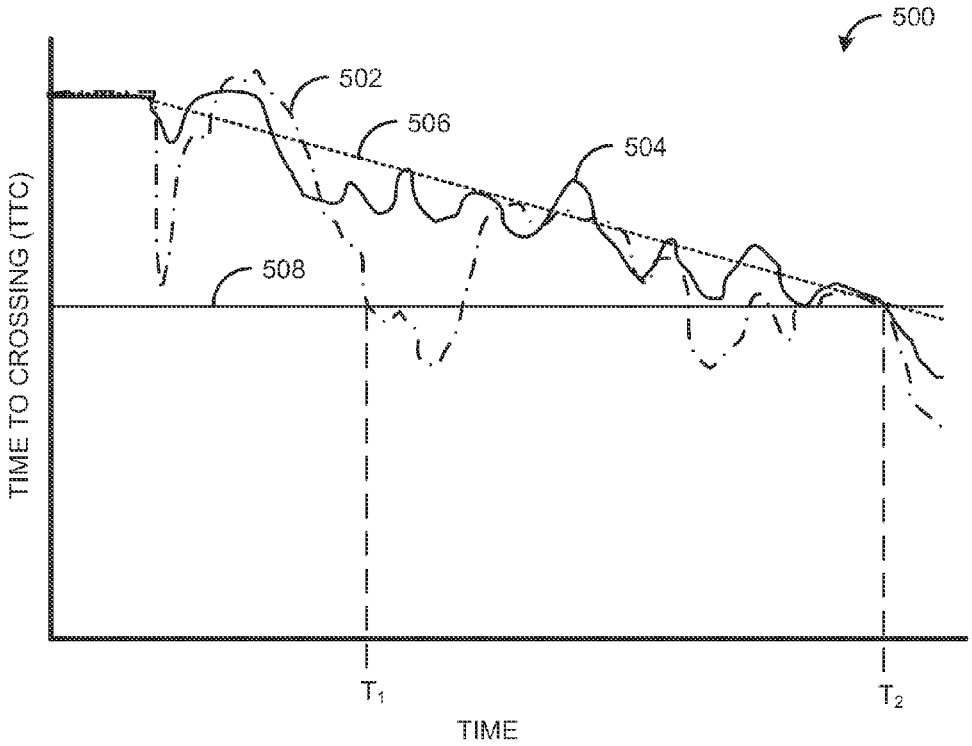
FIG. 5 is a graph illustrating a position-based filter signal and a velocity-based filter signal according to an embodiment of the present disclosure.

FIG. 5 is a graph 500 illustrating the time-to-crossing (TTC) of a vehicle as it approaches a crossing. Graph 500 illustrates two mechanisms for determining the TTC of the vehicle, a position-based determination (dashed-dotted line 502) wherein the determined position may be filtered to a greater extent than the velocity (used, for example, in previous crossing prediction systems), as well as the velocity-based determination according to an embodiment of the present disclosure (shown as solid line 504) wherein the velocity is filtered to a greater extent than the position. The velocity-based determination may be calculated according to the routine 400 of FIG. 4. A theoretical TTC, shown as dotted line 506, is also illustrated. The theoretical TTC may be an ideal estimated TTC for the vehicle that is calculated once initial vehicle position and velocity is known, with the assumption that vehicle velocity remains constant. A threshold TTC, shown as TTC time 508, may be a TTC that, once reached by the vehicle (as calculated by the position- or velocity-based determination), causes the warning equipment to be activated.

At time $T_1$, the vehicle TTC as calculated by the position-based determination (dashed-dotted line 502), reaches the threshold TTC 508, and as a result a signal is sent to activate the warning equipment. However, as can be seen, due to the error in the TTC calculation caused by the large variation in the position-based determination, this point is earlier than when the theoretical TTC 506 and the TTC as calculated by the velocity-based determination (solid line 504) cross the threshold, shown at time $T_2$. As a result, a longer warning ring time than desired may occur when utilizing a position-based determination, but not when using the velocity-based determination according to the disclosure.

Figure 6:
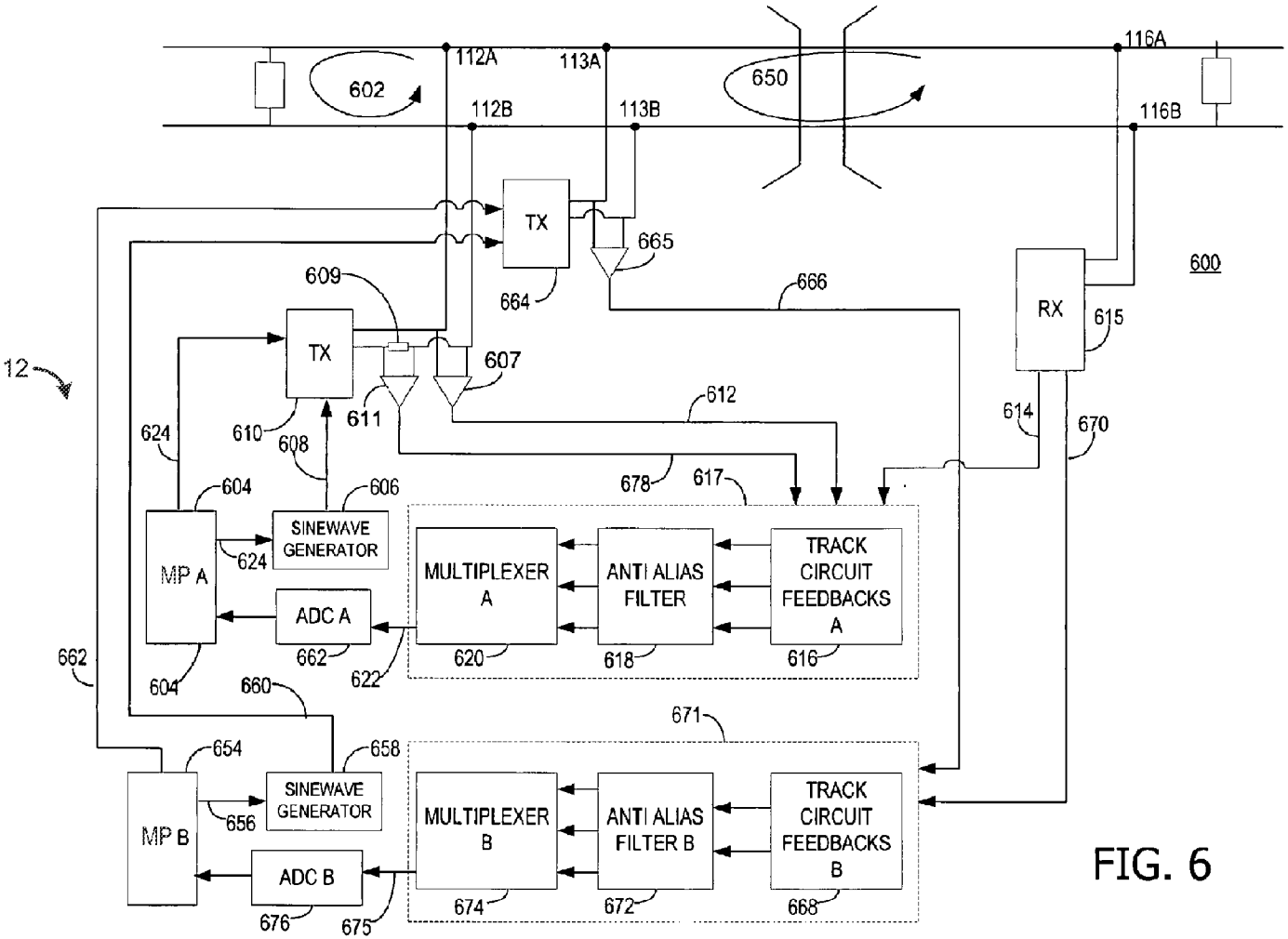
FIG. 6 is an approach track circuit, according to an embodiment.

Referring now to FIG. 6, a system schematic of one embodiment of a track circuit 600 encompassing an approach track circuit 602 (e.g., approach track circuit 128) and an island track circuit 650 (e.g., island track circuit 130) is illustrated. One embodiment utilizes a controller 12 including dual microprocessors (MPs), which may carry out one or more of the control routine of the disclosure. A first microprocessor (MP A) 604 provides a sine wave output signal 626 to sine wave generator 606 to produce an approach sine wave 608 that is a true sine wave with minimal harmonic content. The MP A 604 provides an approach gain signal 624 that provides gain control for the approach transmitter 610. Approach sine wave 608 is provided to the approach transmitter 610 that amplifies the approach sine wave signal 608 based on approach gain signal 624 and transmits the amplified approach signal on the rail 18 via the transmitter leads 112A and 112B.

The approach track circuit 602 generates feedback 612 indicative of the voltage transmitted along the rail 18, and a feedback 678 indicative of the transmitted current. Differential amplifiers can be used to provide the transmitted voltage feedback 612 and the transmitted current feedback 678. For example, a differential input amplifier 607 is connected to lead 112A and lead 112B, and the output provides feedback voltage 612 representing the voltage of the transmitted approach signal. A resistor 609 is interposed in series with output lead 112B, and a differential input amplifier 611 has its inputs connected to the respective ends of resistor 609 in order to provide a feedback current signal 678 representative of the value of the constant current applied to the track.

A received voltage feedback 614 represents the transmitted approach signal voltage picked up by the receiver via leads 116A and 116B. In one embodiment, the receiver 615 is another differential input amplifier having its inputs connected to the tie points 116A and 116B, and the output signal from amplifier is a voltage representative of the received approach signal. Feedbacks 612, 678 and 614 are provided to the data acquisition system 617 comprised of a track circuit feedback 616, anti-alias filter 618, and multiplexer 620. As known to those skilled in the art, multiplexing involves sending multiple signals or streams of information at the same time in the form of a single, complex signal (i.e., a multiplex signal). In this case, the anti-alias filter 618 receives the transmitted voltage feedback 612, the transmitted current feedback 678, and the received voltage feedback 614 to eliminate, for example, noise in the received feedback signals. The multiplexer 620 is coupled to the anti-alias filter and multiplexes the filtered first transmitted voltage feedback 612, the filtered first transmitted current feedback 678, and the filtered first received voltage feedback 614 to generate a multiplexed analog signal 622. The multiplexed analog signal 622 is provided to an analog to digital converter 662 where the analog signal is sampled and digitized and converted into first digital signals that correspond to the transmitted voltage feedback 612, the transmitted current feedback 678, and the received voltage feedback 614.

The first digital signals are digitally bandpass filtered within the MP A 604 and the filtered data is processed to determine signal level and phase. In particular, the first digital signals are processed to determine the frequency and magnitude of the transmitted voltage feedback 612, the transmitted current feedback 678, and the received voltage feedback 614. Processing the first digital signals also includes digitally filtering the second digital signals to determine if the frequency of the received voltage feedback 614 is within a first passband range. If the received voltage feedback 614 is determined to be within a first passband range, the MP A 604 uses the determined signal level (i.e., magnitude) and phase data to calculate the overall track impedance, which in turn determines the presence and motion of a train within the approach track circuit 128. In an alternate embodiment, the MP A 604 provides the data that includes the signal level and signal phase to a different processor (not shown) that calculates the overall track impedance, which in turn determines the presence and motion of a train within the approach track circuit 128.

Similarly, a second microprocessor (MP B) 654 generates a sine wave output signal 656 to a second sine wave generator 658 to produce an island sine wave signal 660. Island sine wave signal 660 is provided to island transmitter 664 that amplifies the island sine wave signal 660 based on island gain control signal 663 provided by the MP B 654. This amplified island signal is transmitted onto rail 18 via the isolated transmitter leads 113A and 113B. Of course in different embodiments, the island track circuit 130 may utilize the same set of transmit leads.

The island track circuit 650 generates feedback 666 indicative of the transmitted voltage and generates feedback 670 indicative of the received voltage. In this case, a differential input amplifier 665 can be connected to leads 113A and 113B, and the output provides feedback voltage 666 representing the voltage of the transmitted approach signal. The received voltage feedback 670 represents the transmitted island signal voltage picked up by the receiver via leads 116A and 116B. The transmitted voltage feedback 666, and the received voltage feedback 670 are provided to the data acquisition system 671 comprised of a track circuit feedback 668, anti-alias filter 672, and multiplexer 674 to generate multiplexed analog signals 675. The second multiplexed analog signals 675 are provided to an analog to digital converter 676 where the signals are digitized and converted into second digital signals. The second digital signals are digitally bandpass filtered within MP B 654 and the filtered data is processed for determination of the signal level. In particular, the second digital signals are processed to determine the frequency and magnitude of the transmitted voltage feedback 666 and the received voltage feedback 670. Processing the second digital signals also includes digitally filtering the second digital signals to determine if the frequency of the received second signal is within a second passband range adjacent to the first passband frequency range. If the frequency of the received second signal is determined to be within a second passband range, the MP B 654 uses the determined signal level (i.e., magnitude) to determine train presence within the island 118.

Another embodiment of the present system is to sample the signal recovered from the track at an integer multiple of the frequency of the transmitted signal. Referring to FIG. 6, the MP A 604 and sine wave generator 606 serve to create an approach sine wave signal 608 of frequency Af. To aid in the digital signal processing and ultimately increase the accuracy of the received signal, the MP A 604 provides a programmable clock in the form of approach sample clock (not shown) to the analog-to-digital converter ADC A 662 that is programmed to N times Af, where N is an integer value (i.e., 1, 2, 3 . . . ). The same method is used for the island circuit where MP B 654 and sine wave generator 658 create an island sine wave signal 660 of frequency Ai. The MP B 654 provides a programmable clock as island sample clock (not shown) to ADC B 676 programmed to Q times Ai, where Q is an integer value (i.e., 1, 2, 3 . . . ). N and Q are selected based upon the microprocessor filter design requirements. This allows for the filter coefficients to be optimized to recover the transmitted signal in question and the resulting data acquisition and filtering of noise from the signal to be achieved by changing only the MP software.

Another embodiment of the present system is that the anti-alias filters are also programmable via the MP software. Referring again to FIG. 6, MP A 604 presents a programmable clock 682 to anti-alias filter A 618 that is programmed to M times Af. Similarly MP B 654 provides a programmable clock to anti-alias filter B 672 programmed to P times Ai. In one embodiment, the anti-alias filter circuits are realized using a switched-capacitor filter device. M and P are selected based upon the device requirements and anti alias-filter (AAF) requirements for rejecting out of band signals. This allows the desired bandpass filtering to be achieved by changing only the MP software.

Another embodiment of the present system is that by making the data acquisition sampling clocks and anti-alias filter clocks programmable, only one configuration of hardware is needed to realize and support the entire range of frequencies for a railroad grade crossing system. This reduces cost for the manufacturer in the form of a reduced number of systems that have to be manufactured and stocked and also for the user in that a fewer number of spare systems have to be purchased and maintained.

Another embodiment relates to a crossing system comprising a controller. The controller is configured (e.g., executes program instructions that cause the controller to perform designated steps/functions) to determine a filtered velocity of a vehicle traveling on a first path, by differentiating a filtered vehicle position with respect to time. The controller is further configured, based on the filtered velocity, to determine a time-to-crossing for the vehicle to reach a crossing. The crossing is between the first path and a second path, and there is warning equipment in place at the crossing for traffic control. The controller is further configured to respond to the vehicle reaching a threshold time-to-crossing by sending a signal to activate the warning equipment. In another embodiment, the filtered velocity is filtered to a greater extent than the filtered vehicle position at least above a threshold frequency.

While the improved system and technique of this application for the generation and detection of signals sent along railroad rails has been described in conjunction with railroad crossings, and more particularly in connection with the detection of trains approaching such crossings, the system and technique of this invention may be used in other railroad wayside applications. For example, the system and technique may be used for train detection in connection with the operation of interlocking equipment for switches between tracks. Further, the system and technique may be used in track circuit applications in which the transmitter and receiver are located at spaced locations along the rails to detect the presence of a train in the interval between the transmitter and receiver. They may also be used for cab signaling in which the transmitter is located along the rail and the receiver is located on-board a locomotive for transmitting information from wayside to the locomotive, such as signal aspect information.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method carried out by non-transitory instructions stored on a controller, comprising:

determining a vehicle position of a vehicle from sensed data;

filtering the vehicle position;

determining vehicle velocity based on the filtered vehicle position;

filtering the vehicle velocity to a greater extent than the vehicle position is filtered, at least above a threshold frequency; and determining a time-to-crossing based on the filtered vehicle position and filtered vehicle velocity, further comprising:

when the time-to-crossing reaches a threshold travel time, sending a signal to activate warning equipment at a crossing that the vehicle is approaching, wherein the vehicle is a rail vehicle.

2. The method of claim 1, wherein determining the vehicle velocity based on the filtered vehicle position further comprises differentiating the filtered vehicle position with respect to time.

3. The method of claim 1, wherein the time-to-crossing is a travel time from a predetermined position for the vehicle to reach a crossing between a vehicle path and an alternate path.

4. The method of claim 3, wherein the vehicle position is an average percentage distance from the crossing relative to a shunt on the vehicle path.

5. The method of claim 1, wherein the filtered velocity comprises a non-linear weighted average velocity of the vehicle.

6. The method of claim 5, wherein the non-linear weighted average velocity comprises a weighted average of a current velocity and a plurality of previous velocities.

7. The method of claim 6, wherein the current velocity comprises a first, largest portion of the weighted average, and wherein the plurality of previous velocities comprises a smaller portion of the weighted average.

8. The method of claim 5, wherein determining the non-linear weighted average velocity further comprises averaging a plurality of calculated non-linear weighted average velocities.

9. A crossing system, comprising:

warning equipment controlling a crossing between a first path and a second path; and a controller including instructions to:

determine a filtered velocity of a vehicle traveling on the first path by differentiating a filtered vehicle position with respect to time;

based on the filtered velocity, determine a time-to-crossing for the vehicle to reach the crossing; and respond to the vehicle reaching a threshold time-to-crossing by sending a signal to activate the warning equipment, wherein, above a threshold frequency, the filtered velocity is filtered to a greater extent than the filtered vehicle position, and wherein below the threshold frequency, the filtered velocity is filtered to a similar extent as the vehicle position, and wherein the vehicle is a rail vehicle.

10. The crossing system of claim 9, wherein the filtered velocity comprises a non-linear weighted average velocity.

11. The crossing system of claim 10, wherein the non-linear weighted average velocity comprises a weighted average of a current velocity and a plurality of previous velocities.

12. The crossing system of claim 11, wherein the current velocity comprises a first, largest portion of the weighted average, a first and second of the previous velocities immediately previous to the current velocity each comprise a second, smaller portion of the weighted average, and a third, fourth, and fifth of the previous velocities immediately previous to the first and second previous velocities each comprise a third, smallest portion of the weighted average.

13. The crossing system of claim 9, wherein the filtered vehicle position is an average percentage distance from the crossing relative to a shunt of the first path upstream of the crossing.

14. The crossing system of claim 9, wherein the filtered vehicle position has a maximum value.

15. A method carried out by non-transitory instructions stored on a controller, comprising:

determining a vehicle position of a vehicle with respect to a crossing on a vehicle path;

determining a non-linear weighted average velocity of the vehicle based on a change of vehicle position;

responsive to the change of vehicle position less than a first threshold, determining a time-to-crossing based on the vehicle position and the non-linear weighted average velocity and sending a signal to activate warning equipment at the crossing in response to the time-to-crossing reaching a second threshold; and responsive to the change of vehicle position greater than the first threshold, waiting until the change of vehicle position is less than the first threshold before determining the time-to-crossing, wherein the vehicle is a rail vehicle.

16. The method of claim 15, wherein the path is rail track.

17. The method of claim 15, wherein the second threshold is preset by a user.

18. The method of claim 15, wherein the vehicle position comprises an average percent distance to the crossing relative to a shunt of the vehicle path upstream of the crossing.

19. The method of claim 15, wherein the vehicle position has a maximum value.

* * * * *